US005887992A

United States Patent [19]

Yamanashi

[11] Patent Number: 5,887,992

[45] Date of Patent: Mar. 30, 1999

[54] COMPACT PRINTING DEVICE WITH MEANS FOR MAINTAINING DISTANCE BETWEEN PRINT HEAD AND PRINT MEDIUM

[75] Inventor: Motoaki Yamanashi, Nagoya, Japan

[73] Assignee: Brother Kogyo Kabushiki Kaisha, Nagoya, Japan

[21] Appl. No.: 760,958

[22] Filed: Dec. 5, 1996

[30] Foreign Application Priority Data

Dec. 5, 1995 [JP] Japan ..... 7-316425

[51] Int. Cl.[6] ..... B41J 3/39

[52] U.S. Cl. ..... 400/88; 347/8; 347/109

[58] Field of Search ..... 400/88, 29; 346/143; 347/8, 87, 109

[56] References Cited

U.S. PATENT DOCUMENTS

| | | | |
|---|---|---|---|
| 4,412,232 | 10/1983 | Weber et al. . | |
| 4,523,235 | 6/1985 | Rajchman | 358/256 |
| 4,901,164 | 2/1990 | Kurosawa | 400/88 |
| 4,947,262 | 8/1990 | Yajima et al. | 400/88 |
| 5,593,236 | 1/1997 | Bobry | 400/898 |
| 5,595,445 | 1/1997 | Bobry | 400/88 |

FOREIGN PATENT DOCUMENTS

| | | | |
|---|---|---|---|
| 255465 | 12/1985 | Japan | 400/88 |
| 222864 | 9/1987 | Japan | 400/88 |
| 225371 | 10/1987 | Japan | 400/88 |
| 125360 | 5/1988 | Japan | 400/88 |
| 001564 | 1/1989 | Japan | 400/88 |
| 271263 | 10/1989 | Japan | 400/88 |
| 127057 | 5/1990 | Japan | 400/88 |

*Primary Examiner*—Ren Yan
*Attorney, Agent, or Firm*—Oliff & Berridge, PLC

[57] ABSTRACT

A compact printing device for printing inputted image data at a desired position on a print medium by scanning, in a scanning direction, the printer over the desired position of the print medium and including a body having a lower end confronting the print medium during printing, the lower end having a first region and a second region opposite each other with respect to a second direction perpendicular to the scanning direction; a print head for printing images on the print medium surface based on the inputted print image data and provided to the lower end of the body in the first region; and distance maintenance member for maintaining a set distance between the print head and the desired position on the print medium and provided to the lower end of the body in the second region.

16 Claims, 4 Drawing Sheets

COMPACT PRINTING DEVICE WITH MEANS FOR MAINTAINING DISTANCE BETWEEN PRINT HEAD AND PRINT MEDIUM

BACKGROUND OF THE INVENTION

1. Field of the Invention

The present invention relates to a compact printing device for printing images on a printing medium by manually scanning the printing device over the printing medium without the aid of a transport means.

2. Description of the Related Art

There has been known a compact printing device for printing images on a printing medium by manual scanning the printing device over the printing medium without the aid of a transport.

FIG. 1 Is a perspective view showing a print data input portion 100 of a conventional compact printing device. The input portion 100 includes at its outer front surface Hiragana keys 102, conversion keys 104 and a liquid crystal panel 106. FIG. 2 is a schematic cross-sectional view showing essential configuration of a printing portion of the conventional compact printing device. The printing portion 110 includes a right roller 120, a left roller 122, an ink ejecting ink jet head 124 formed between the right and left rollers 120 and 122, and a head controller 112 for controlling the ink jet head 124. Although not show in the drawings, a CPU is housed inside the printing device 1.

Next, a process for printing images using this type of printing device will be described. First, a user inputs printing data using the keys 102 and 104, and confirms their accuracy on the liquid crystal panel 106. The CPU converts the printing data into printing image data and transmits the data to the head controller 112.

The user then manually scans the printing device 1 across a printing medium 114 in a scanning direction indicated by an arrow B in FIG. 1. At this time, the printer portion of the printing device, that is, a bottom surface s viewed in FIG. 2, is pressed against the printing medium 114. The rollers 120,122 rotate in association with scanning movement of the printing device. The head controller 112 controls the ink jet head 124 to eject ink to print the printing image data on the printing medium 114.

SUMMARY OF THE INVENTION

In the ink jet head having above-described configuration, the right and left rollers 120 and 122 obstruct the user's view of the ink jet head 124 during printing and of the printed image directly after printing. Therefore, it is difficult for a user to ascertain precise printing positions. As a result, the user may scan the printing device in an unstable manner, resulting in distorted characters, crooked rows, or both.

Also, it is difficult for a user to determine how much space remains for printing on the printing medium 114, resulting in the user mistakenly printing across the edges of the printing sheet 114. Moreover, the user might mistakenly stop the printing device in the middle of a character or word, resulting in illegible printed text.

It is an object of the present invention to solve the above-described problems and to provide a compact printing device, wherein portions around the print head can be seen by the user during printing, thereby allowing a user to easily and precisely determine printing positions on the printing medium.

To achieve the above objects, a compact printing device includes a print means for printing images on printing medium based on a printing image data and a distance maintenance means for keeping a constant distance between the printing means and a printing position on the printing medium. The distance maintenance means is configured to allow a user to see the area in the vicinity of the printing position.

A compact printing device according to the present invention is for printing inputted image data at a desired position on a print medium by scanning, in a scanning direction, the printer over the desired position of the print medium. The printer includes a body having a lower end confronting the print medium during printing, the lower end having a first region and a second region opposite each other with respect to a second direction perpendicular to the scanning direction; a print means for printing images on the print medium surface based on the inputted print image data and provided to the lower end of the body in the first region; and distance maintenance means for maintaining a set distance between the print means and the desired position on the print medium and provided to the lower end of the body in the second region.

The print means prints images based on the image data while the distance maintenance means maintains a constant distance between the print means and the printing medium. Also, the user can see the printing positions on the printing medium. This allows the user precisely to determine printing positions and when to stop scanning at the ends of character rows and at the edges of the printing medium.

A compact printing device according to another aspect of the present invention includes: a body having a lower end confronting the print medium during printing; print means for printing images on the print medium surface based on the inputted print image data and provided to the lower end of the body; and distance maintenance means for maintaining a set distance between the print means and the desired position on the print medium and provided to the lower end of the body at a position unobstructive of a line of vision between the user and the print means.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
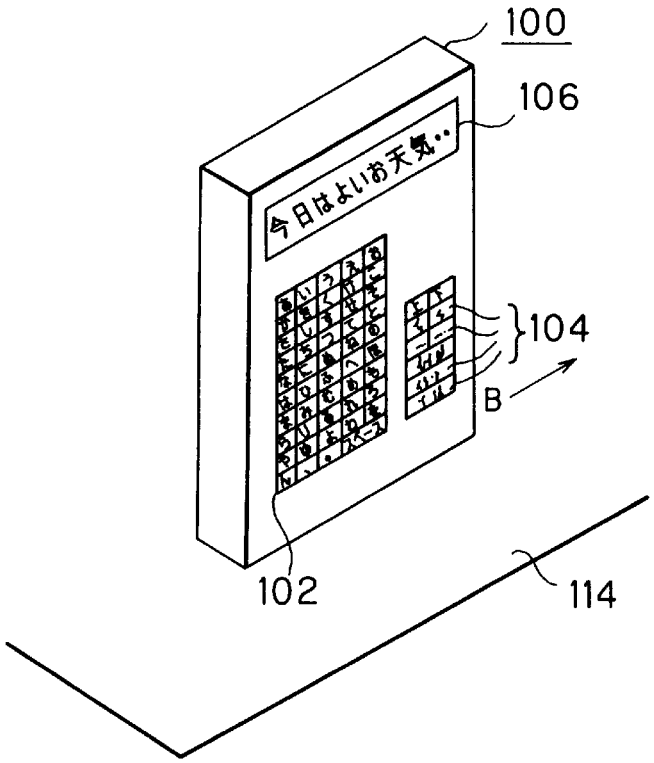
PRIOR ART FIG. 1
FIG. 1 is a perspective view showing a printing data input device of a conventional compact printing device.

A compact printing device according to a preferred embodiment of the present invention will be described while referring to the accompanying drawings wherein like parts and components are designated by the same reference numerals to avoid duplicating description.

Figure 3:
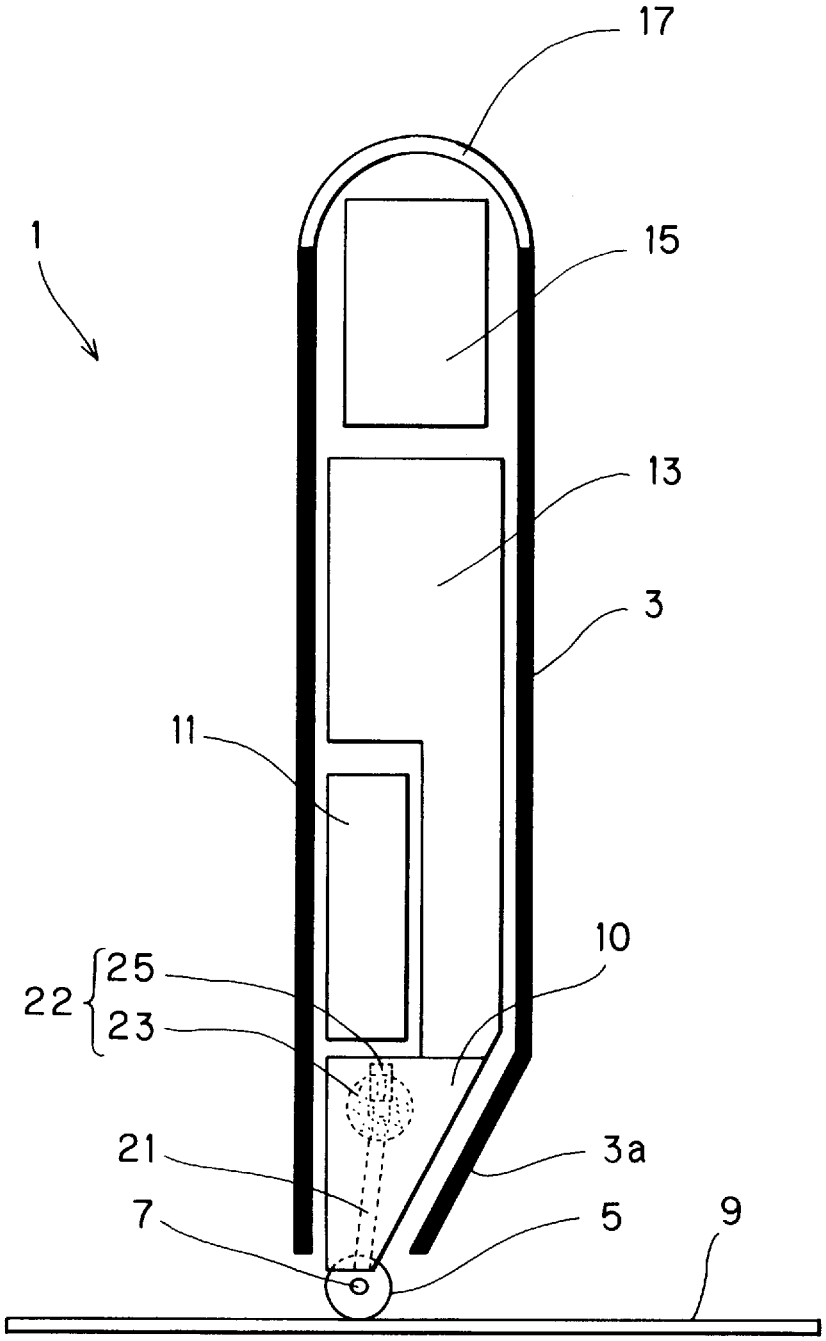
FIG. 3 is a cross-sectional view showing a compact printing device according to an embodiment of the present invention.

FIG. 3 is a cross-sectional view showing a compact printing device 1 of the present invention in an orientation for printing. The compact printing device 1 includes a pen-shaped body 3 with a lower end confronting the paper sheet 9 during printing The body 3 houses an infrared transmission control circuit 15, a head controller 11, an ink tank 13 filled with ink, and a rotation detection unit 22. An infrared transmission unit 17 for transmitting and receiving infrared data between a personal computer (not shown in drawings) is disposed at the upper end of the body 3. An ink jet head 10 serving as a print means and a scan roller 5 serving as a distance maintenance means are provided to the lower end of the body 3.

The rotation detection unit 22 is disposed in the lower side of the body 3 and includes a rotatable encoder 23 and a speed detector 25. The encoder 23 is formed with a plurality of slits disposed at an equiangular interval. The speed detector 25 sandwiches the encoder 23 to detect the rotational speed of the encoder 23 via the slits.

Figure 4:
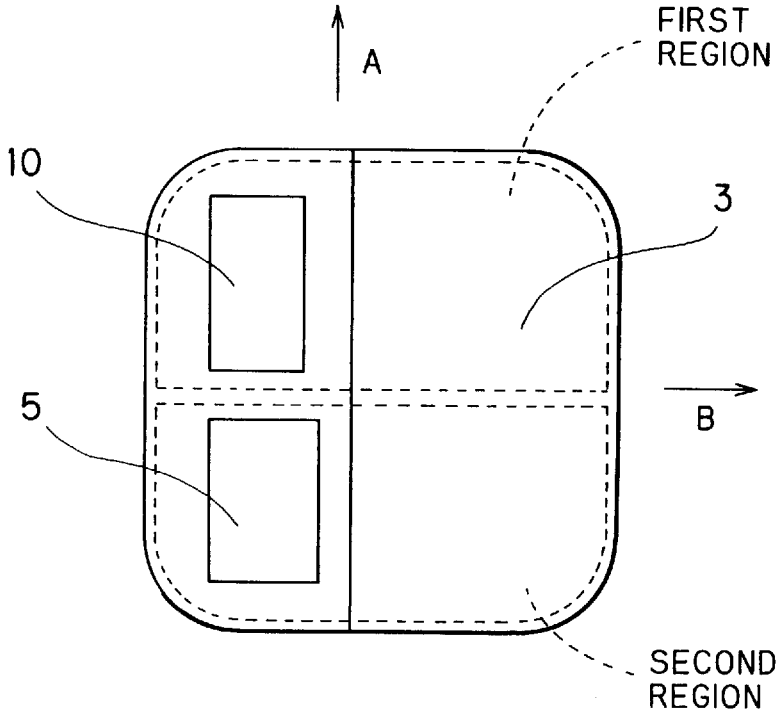
FIG. 4 is a plan view showing a lower end of the printing device of FIG. 3 as viewed from the underside of the printing device.

As best seen in FIG. 4, the ink jet head 10 and the scan roller 5 are aligned in a direction A, which is perpendicular to a scanning direction B. The ink jet head 10 is disposed in a first region of the lower end of the body 3 and the scan roller 5 is disposed in a second region of the lower end of the body 3. The first and second regions of the lower end of the body 3 are at opposite sides of the lower end with respect to the direction A. Also, the ink jet head 10 and the scan roller 5 are disposed on a downstream side of the lower end with respect to the scanning direction B so that, as shown in FIG. 3, the scan roller 5 is to one side of the center of gravity of the printing device 1. With this configuration, the printing device 1 tends to pivot around the scan roller 5 and against the user's hand in the cradle between his or her forefinger and thumb, making it easier for the user to maintain the printing device 1 in the upright orientation for printing with respect to the paper sheet 9.

The scan roller 5 is rotatably supported on a rotation shaft 7 so as to rotate about the rotation shaft 7 when the printing device 1 is scanned across the paper sheet 9. A belt 21 is wrapped between the scan roller 5 and the encoder 23 so that the encoder 23 rotates in association with rotation of the scan roller 5. With this configuration, the speed detector 25 detects rotational speed of the scan roller 5 via the encoder 23 and outputs a signal to the head controller 11 accordingly.

Next, a printing process will be described while referring to FIG. 4. First, the user uses the personal computer to input and edit the print data of images to be printed. The print data is transmitted to the head controller 11 via the infrared transmission control circuit 15.

Then, the user positions the printing device 1 at a desired position on the paper sheet 9 so that a predetermined side of the printing device 1 faces the user, who is located in the direction A from the printing device 1. In this orientation, the ink jet head 10 is nearer the user than is the scan roller 5. Therefore, the user can directly see the ink jet head 10 without interference from the scan roller 5. This allows the user to accurately position the ink jet head 10 at the desired position on the paper sheet 9.

Figure 2:
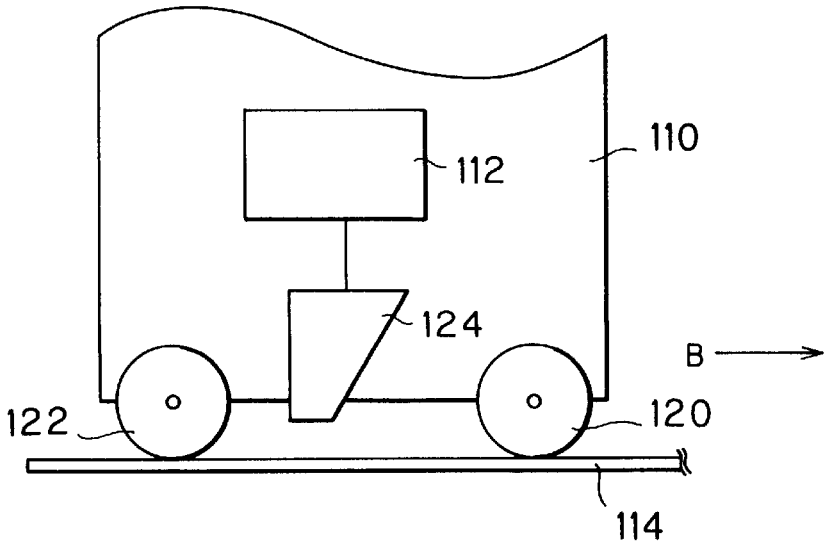
PRIOR ART FIG. 2
FIG. 2 is a schematic cross-sectional view showing essential portions of a printing portion of the conventional device shown in FIG. 1.

Then, while the scan roller 5 is in contact with the paper sheet 9. the user scans the printing device 1 across the sheet 9 in the desired scanning direction indicated by arrow B in FIG. 2. The scan roller 5 rotates across the surface of the sheet 9 and rotation of-the scan roller 5 is transmitted to the encoder 23 by the belt 21. The speed detector 25 detects the rotation of the encoder 23 via the slits and outputs rotation data accordingly to the head controller 11.

The head controller 11 then drives the ink jet head 10 based on the rotation data and on printing data transmitted from the personal computer to eject ink from the ink tank 13 and print images on the paper sheet 9.

The user can directly see a margin near the edge of the sheet where a new row Is to be started and the space remaining until the edge of the printing sheet 9 without obstruction from the scan roller 5. Therefore, the user can complete the printing process precisely at the desired position.

While the invention has been described in detail with reference to specific embodiments thereof, it would be apparent to those skilled in the art that various changes and modifications may be made therein without departing from the spirit of the invention, the scope of which is defined by the attached claims.

Figure 5:
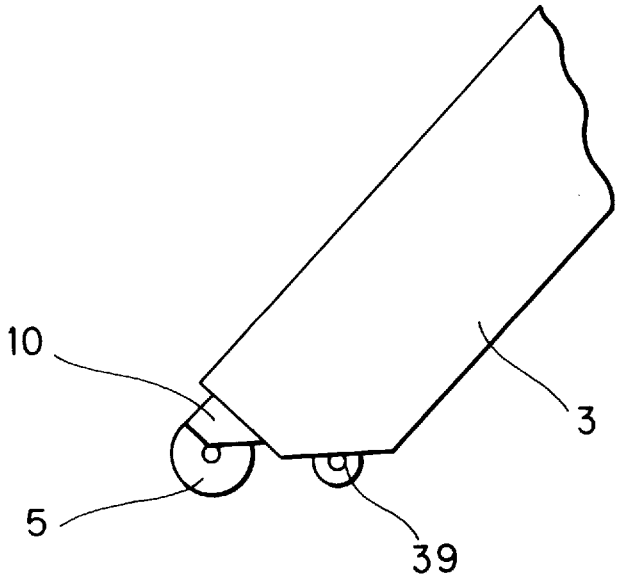
FIG. 5 is a side view showing a printing device according to a second embodiment of the present invention.
Figure 6:
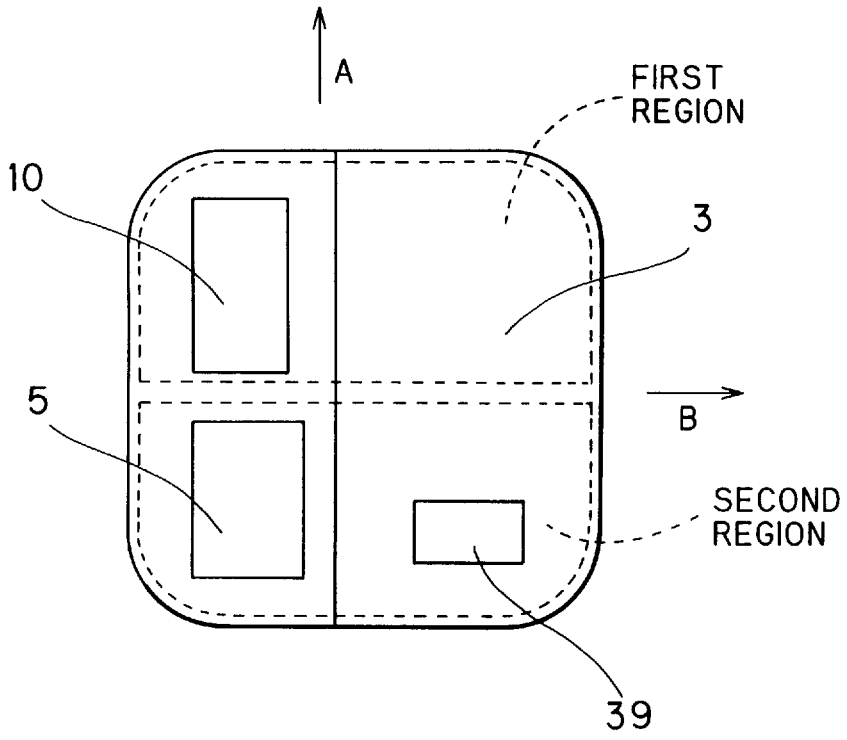
FIG. 6 is a plan view showing the lower end of the printing device of FIG. 5 as viewed from the underside of the printing device.

As shown in FIGS. 5 and 6, a sub roller 39 can be provided for supporting the printing device 1 at a constant angle with respect to the paper sheet 9. In this case, both the scan roller 5 and the sub roller 39 are formed so that the user can see the ink jet head 10. In another words. the scan roller 5 and the sub roller 39 are formed at the side of the ink jet head 10 opposite from the user.

The present invention can be used in a toner type printing head by arranging an electrode under the printing medium. The body 1 can be formed from a transparent material to further enhance ease at which the user can see the ink jet head 5. Also, a motor for rotating the scan roller 5 can be provided to the printing device 1 to enable printing by automatic scanning.

The above embodiment describes the printing device designed for a right-handed user to grasp in his or her right and scan the printing device rightward. However, the positions of the distance maintenance means and the print head 10 can be exchanged so that a left-handed user can see the print head 10 while scanning the printing device across the printing medium leftward with his or her left hand.

Although the first and second regions are shown in FIG. 4 as each occupying roughly half of the lower end, either the first or second region can occupy more than half the lower end as long as they are opposite each other with respect to the direction A. Also, the ink jet head 10 and the scan roller 5 need not be aligned in the direction A nor disposed on the lower end at a position downstream with respect to the scanning direction B.

According to the present invention, the user can view the ink jet head and the print medium to precisely-determine the positions of the ink jet head on the print medium. Therefore, printing processes can be started and completed precisely at desired positions so the user can avoid printing over edges and printing broken words.

What is claimed is:

1. A compact printing device for printing images based on inputted image data at a desired position on a print medium when scanned by a user, in a scanning direction, over the desired position of the print medium, the compact printing device comprising:

a body having a lower end confronting the print medium during printing, the lower end having an end surface area consisting of a first region and a second region opposite each other with respect to a second direction perpendicular to the scanning direction, wherein the first region is exclusively to one side of the second region and the second region is exclusively to one side of the first region and wherein the first region is closer to the user than the second region in the second direction;

a print unit that prints images on the print medium based on the inputted image data, the print unit being provided at the lower end of the body in the first region; and a distance maintenance member that maintains a set distance between the print unit and the desired position on the print medium, the distance maintenance member being rotatably supported on opposite sides at the lower end of the body within the second region of the end surface area, whereby the distance maintenance member does not obstruct a user's view of the print unit.

2. A compact printing device as claimed in claim 1, wherein the print unit and the distance maintenance member are aligned substantially in parallel in the second direction.

3. A compact printing device as claimed in claim 2 wherein the print unit and the distance maintenance member are disposed at the lower end in a downstream half with respect to the scanning direction.

4. A compact printing device as claimed in claim 1, wherein the distance maintenance member is a roller rotatably supported to the lower end of the body.

5. A compact printing device as claimed in claim 4, further comprising a drive member for driving the roller to rotate across the print medium during printing.

6. A compact printing device as claimed in claim 1, further comprising:

a movement detection unit disposed in the body, the movement detection unit detecting movement of the body and outputting a signal accordingly; and a control unit that controls the print unit to print based on the inputted print image data and the signal from the movement detection unit.

7. A compact printing device as claimed in claim 6, wherein the distance maintenance member includes a roller for rolling across the print medium; and the movement detection unit includes:

an encoder connected so as to rotate in association with rotation of the roller; and a speed detector that detects rotational speed of the encoder and outputting a signal accordingly.

8. A compact printing device as claimed in claim 1 wherein the print unit includes an ink jet printer.

9. A compact printing device as claimed in claim 8, wherein the body is pen shaped.

10. A compact printing device as claimed in claim 1 wherein the print unit includes a toner type print head used with an electrode on which the recording medium is disposed.

11. A compact printing device as claimed in claim 1, further comprising an angle maintenance member for maintaining the body at an acute angle with respect to the print medium.

12. A compact printing device as claimed in claim 11, wherein the angle maintenance member is provided on the body at a position in the second region and upstream from the distance maintenance member with respect to the scanning direction.

13. A compact printing device as claimed in claim 12, wherein the angle maintenance member is a roller.

14. A compact printing device as claimed in claim 1, wherein the lower end of the body is formed from a transparent material.

15. A compact printing device as claimed in claim 1, wherein the print unit prints only on a portion of the print medium opposite the first region.

16. A compact printing device as claimed in claim 1, wherein the first region and the second region are substantially equally sized in the second direction.

* * * * *